US011559721B2

(12) United States Patent
Polk et al.

(10) Patent No.: US 11,559,721 B2
(45) Date of Patent: Jan. 24, 2023

(54) CYCLING DEVICE

(71) Applicant: WhiteBoard Product Solutions, Minneapolis, MN (US)

(72) Inventors: Louis Frederick Polk, Excelsior, MN (US); Paul Michael Theisen, New Germany, MN (US)

(73) Assignee: WhiteBoard Product Solutions, Minneapolis, MN (US)

( * ) Notice: Subject to any disclaimer, the term of this patent is extended or adjusted under 35 U.S.C. 154(b) by 0 days.

(21) Appl. No.: 17/306,993

(22) Filed: May 4, 2021

(65) Prior Publication Data

US 2022/0355161 A1 Nov. 10, 2022

(51) Int. Cl.

| | |
|---|---|
| ***A63B 22/06*** | (2006.01) |
| ***A63B 22/00*** | (2006.01) |
| ***A63B 21/22*** | (2006.01) |

(52) U.S. Cl.

CPC ..... *A63B 22/0605* (2013.01); *A63B 21/225* (2013.01); *A63B 22/0046* (2013.01)

(58) Field of Classification Search

CPC ..... A63B 23/03525; A63B 23/035; A63B 23/0476; A63B 21/4034; A63B 21/4033; A63B 21/00058; A63B 21/225; A63B 21/012; A63B 21/0125; A63B 22/06; A63B 22/0025; A63B 22/0015; A63B 22/0012; A63B 22/0017; A63B 22/0007; A63B 22/0005; A63B 2022/0635; A63B 2022/0641; A63B 2022/0647; A63B 2022/0652; A63B 2022/0658; A63B 2200/0611; A63B 2200/0617; A63B 2200/0623; A63B 2200/0629

USPC ..... 482/57

See application file for complete search history.

(56) References Cited

U.S. PATENT DOCUMENTS

| | | | | |
|---|---|---|---|---|
| 1,820,372 A * | 8/1931 | Blomquist | ..... | A63B 22/001 482/62 |
| 2,190,895 A | 2/1940 | Turpin | | |
| 2,388,777 A | 11/1945 | Wentz | | |
| 2,673,088 A | 3/1954 | Wentz | | |
| 3,259,385 A * | 7/1966 | Boren | ..... | A63B 22/0694 248/165 |
| 3,758,111 A * | 9/1973 | Agamian | ..... | A63B 22/0023 482/57 |
| 3,968,963 A | 7/1976 | Sileo | | |

(Continued)

FOREIGN PATENT DOCUMENTS

| | | |
|---|---|---|
| CN | 108211288 A | 6/2018 |
| GB | 2525850 A | 11/2015 |

(Continued)

OTHER PUBLICATIONS

European Search Report dated Oct. 4, 2022, issued in corresponding EP Appln. No. 22171701, 7 pages.

*Primary Examiner* — Megan Anderson
*Assistant Examiner* — Thao N Do
(74) *Attorney, Agent, or Firm* — Moyles IP, LLC; Bradley J. Shelowitz

(57) ABSTRACT

A cycling device used for exercise and/or rehabilitation includes a shaft for grasping by a user, a foot assembly coupled to the shaft and configured to be supported on a surface, and a pedal assembly coupled between the shaft and the foot assembly. The cycling device is intended to be used by a seated user.

19 Claims, 4 Drawing Sheets

(56) References Cited

U.S. PATENT DOCUMENTS 4,222,376 A * 9/1980 Praprotnik ..... A61H 1/0214 601/24
4,262,902 A 4/1981 Dranselka
4,373,716 A * 2/1983 Pagani ..... A63B 21/0004 482/130
4,521,009 A 6/1985 Pomeroy
4,717,146 A 1/1988 Nohara
4,828,522 A 5/1989 Santos
4,838,547 A 6/1989 Sterling
4,973,046 A * 11/1990 Maxwell ..... A63B 22/0694 601/36
5,108,092 A 4/1992 Hurst
5,647,822 A * 7/1997 Avganim ..... A63B 22/0007 482/57
5,669,863 A * 9/1997 Ho ..... A63B 23/0405 482/125
5,820,520 A * 10/1998 Sieber ..... A63B 23/0227 482/148
5,989,162 A * 11/1999 Daniels ..... A63B 22/0694 482/62
6,071,215 A * 6/2000 Raffo ..... A63B 22/0076 72/142
7,422,549 B2 9/2008 Matthews
7,819,788 B1 * 10/2010 Ho ..... A63B 23/0222 482/122
D636,826 S * 4/2011 Chan ..... D21/663
9,387,354 B1 7/2016 Santoro
9,474,930 B2 10/2016 Hsu
9,566,469 B1 * 2/2017 Rector ..... A63B 21/22
10,702,739 B1 * 7/2020 McCormack ..... A63B 21/0428
D918,316 S * 5/2021 Zhu ..... D21/663
D952,063 S * 5/2022 Lv ..... D21/663
2003/0092536 A1 5/2003 Romanelli et al.
2004/0058783 A1 * 3/2004 He ..... A63B 22/00 482/57
2007/0129219 A1 * 6/2007 Mahlberg ..... A61H 1/0237 482/57
2007/0197355 A1 * 8/2007 Brown ..... A63B 23/03533 482/57
2007/0238588 A1 * 10/2007 Butler ..... A63B 21/4035 482/77
2008/0300113 A1 * 12/2008 Battiston ..... A63B 22/0012 482/51
2009/0192024 A1 * 7/2009 Wu ..... A63B 71/0619 482/57
2009/0264266 A1 * 10/2009 Solow ..... A63B 21/023 482/130
2010/0113230 A1 * 5/2010 Brown ..... A63B 21/008 482/111
2010/0234192 A1 * 9/2010 Oller, Jr. ..... A63B 21/4047 482/131
2011/0281693 A1 * 11/2011 Arstein ..... A63B 26/003 482/57
2012/0238411 A1 * 9/2012 McBride ..... A63B 22/0005 482/57
2012/0238413 A1 * 9/2012 McBride ..... A63B 22/0605 482/62
2013/0237386 A1 * 9/2013 Tsai ..... A63B 21/015 482/60
2017/0136330 A1 * 5/2017 Stevens ..... A63B 69/004
2019/0054345 A1 * 2/2019 Hsu ..... A63B 22/0605
2019/0201738 A1 * 7/2019 Johnson ..... A63B 22/0005
2019/0321682 A1 * 10/2019 Davies, III ..... A63B 23/12
2020/0038705 A1 * 2/2020 Van Straaten ..... A63B 22/0015
2020/0276471 A1 * 9/2020 Ellis ..... A63B 21/154
2021/0046355 A1 * 2/2021 Trevino ..... A63B 23/1236
2021/0162290 A1 * 6/2021 Benson ..... A61H 3/04
2022/0096895 A1 * 3/2022 Tsai ..... A63B 21/00069

FOREIGN PATENT DOCUMENTS

JP 4970880 B2 7/2012
KR 20130079238 A 7/2013

* cited by examiner

CYCLING DEVICE

BACKGROUND

Technical Field

The present disclosure relates to cycling devices, and more particularly, to a cycling device having pedals for exercising or rehabilitating limbs of a user.

Background of Related Art

Cycling devices are often used to promote good health and/or for rehabilitating an injury. One example of a cycling device is a stationary bicycle, which includes pedals attached to a crank subject to a resistive force such that a user may cyclically move their feet to turn the pedals against the resistive force. Some cycling devices are designed to be portable and to be placed on either a floor or a tabletop so a user may engage the pedals with their legs or arms. There is a continuing need for improving the usability, transportability, and/or convenience of use of cycling devices.

SUMMARY

In accordance with an aspect of the present disclosure, a cycling device for exercise or rehabilitation is provided and includes an elongate shaft having a handle portion and a base portion, a pedal assembly coupled to the elongated shaft, and a foot assembly including a crossbar, a first foot, and a second foot. The crossbar defines a longitudinal axis, is coupled to the base portion, and has first and second end portions. The first foot is coupled to the first end portion of the crossbar and the second foot is coupled to the second end portion of the crossbar. The crossbar is configured to rotate about the longitudinal axis thereof relative to the first and second feet to adjust an angular position of the handle portion of the elongate shaft.

In aspects, the crossbar may be resiliently biased toward a set rotational orientation relative to the first and second feet.

In aspects, the foot assembly may further include a biasing member coupled between the first foot and the crossbar to resiliently bias the crossbar toward the set rotational orientation.

In aspects, the foot assembly may further include a first block and a second block. The first block may be rotationally fixed in the first foot and fixed to the biasing member. The second block may be rotationally fixed to the crossbar and fixed to the biasing member such that the second block is configured to rotate relative to the first block in response a rotation of the crossbar relative to the first and second feet.

In aspects, the biasing member may be a torsion spring.

In aspects, the foot assembly may further include a fastener fixed relative to the first foot. The crossbar may define a slot configured for receipt of the fastener such that the fastener limits an amount of rotation of the crossbar relative to the first and second feet in opposing first and second rotational directions.

In aspects, the fastener may fix the first foot to the first block.

In aspects, the first end portion of the crossbar may define the slot. The first end portion of the crossbar may be rotationally supported in the first foot and disposed about the first block.

In aspects, the first foot may have a flat bottom configured to be flush with a ground surface.

In aspects, the crossbar may be resiliently biased toward a set rotational orientation relative to the first and second feet. The elongate shaft may be perpendicular relative to the flat bottom of the first foot when the crossbar is in the set rotational orientation relative to the first and second feet.

In aspects, the pedal assembly may include a crankarm and first and second pedals. The crankarm may be rotationally supported by the base portion of the elongate shaft and may have a first end portion and a second end portion. The first pedal may be coupled to the first end portion of the crankarm and the second pedal may be coupled to the second end portion of the crankarm.

In aspects, the handle portion may be rotatable relative to the base portion to adjust a tensioning mechanism associated with the crankarm.

In aspects, the elongate shaft may include a handle extension coupled between the handle portion and the base portion.

In aspects, the first and second feet may be the only points of contact between the cycling device and a ground surface.

In aspects, the crossbar may extend perpendicularly relative to the base portion.

In accordance with further aspects of the disclosure, a cycling device for exercise or rehabilitation is provided that includes an elongate shaft having a handle portion and a base portion, a pedal assembly coupled to the elongate shaft, and a foot assembly including first and second arms. The first arm is coupled to the base portion and supports a first foot and the second arm is coupled to the base portion and supports a second foot. The first and second arms are configured to rotate relative to the first and second feet between a first position and a second position. In the first position, the handle portion is disposed at a first angular orientation relative to the first and second feet. In the second position, the handle portion is disposed at a second angular orientation relative to the first and second feet. The first arm is resiliently biased toward the first position.

In aspects, the foot assembly may further include a biasing member coupled between the first foot and the first arm to resiliently bias the first arm toward the first position.

In aspects, the foot assembly may further include a first block and a second block. The first block may be rotationally fixed in the first foot and fixed to the biasing member. The second block may be rotationally fixed in the first arm and fixed to the biasing member such that the second block is configured to rotate relative to the first block in response to a rotation of the first arm relative to the first foot.

In aspects, the foot assembly may further include a fastener fixed relative to the first foot. The first arm may define a slot configured for receipt of the fastener such that the fastener limits an amount of rotation of the first arm relative to the first foot in opposing first and second rotational directions.

As used herein, the terms parallel and perpendicular are understood to include relative configurations that are substantially parallel and substantially perpendicular up to about + or −15 degrees from true parallel and true perpendicular.

As used herein, the term "about" means that the numerical value is approximate and small variations would not significantly affect the practice of the disclosed embodiments. Where a numerical limitation is used, unless indicated otherwise by the context, "about" means the numerical value can vary by ±10% and remain within the scope of the disclosed embodiments.

BRIEF DESCRIPTION OF THE DRAWINGS

Embodiments of the present disclosure are described herein with reference to the accompanying drawings, wherein.

DETAILED DESCRIPTION

Figure 1A:
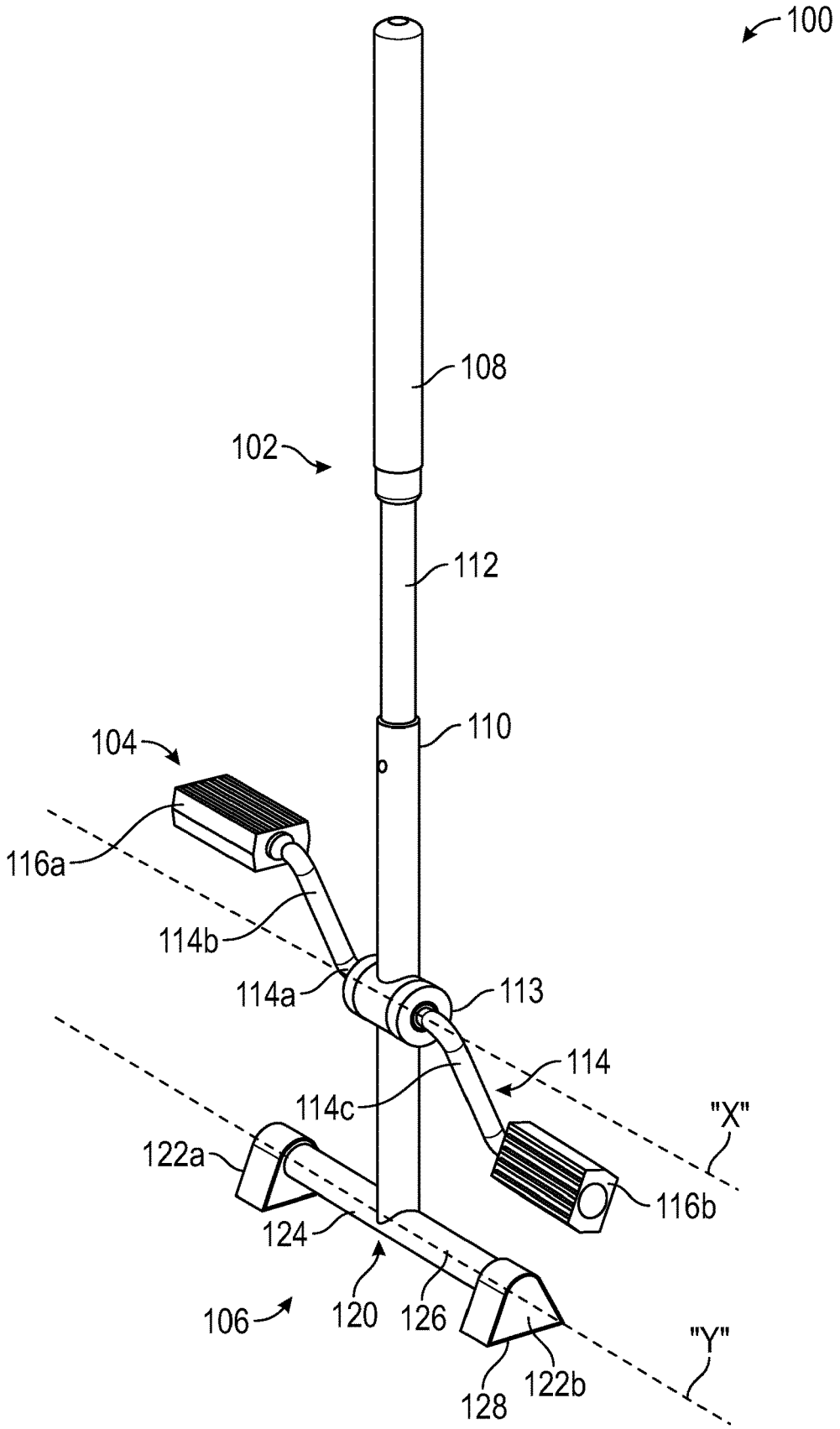
FIG. 1A is a front perspective view illustrating an exemplary embodiment of a cycling device.

Embodiments of the presently disclosed cycling devices are described in detail with reference to the drawings, in which like reference numerals designate identical or corresponding elements in each of the several views.

Figure 1B:
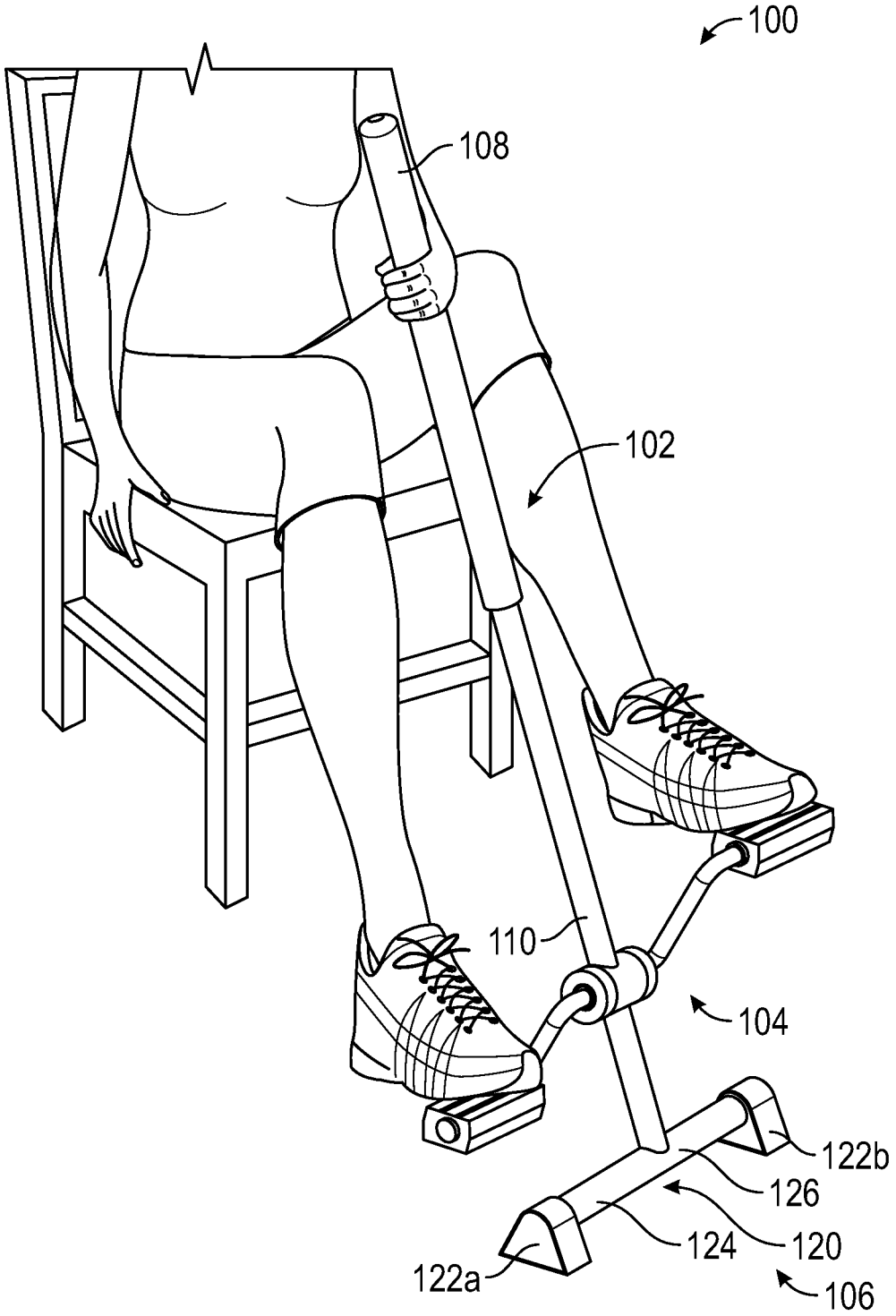
FIG. 1B is a front perspective view illustrating the cycling device of FIG. 1A shown in use.
Figure 2:
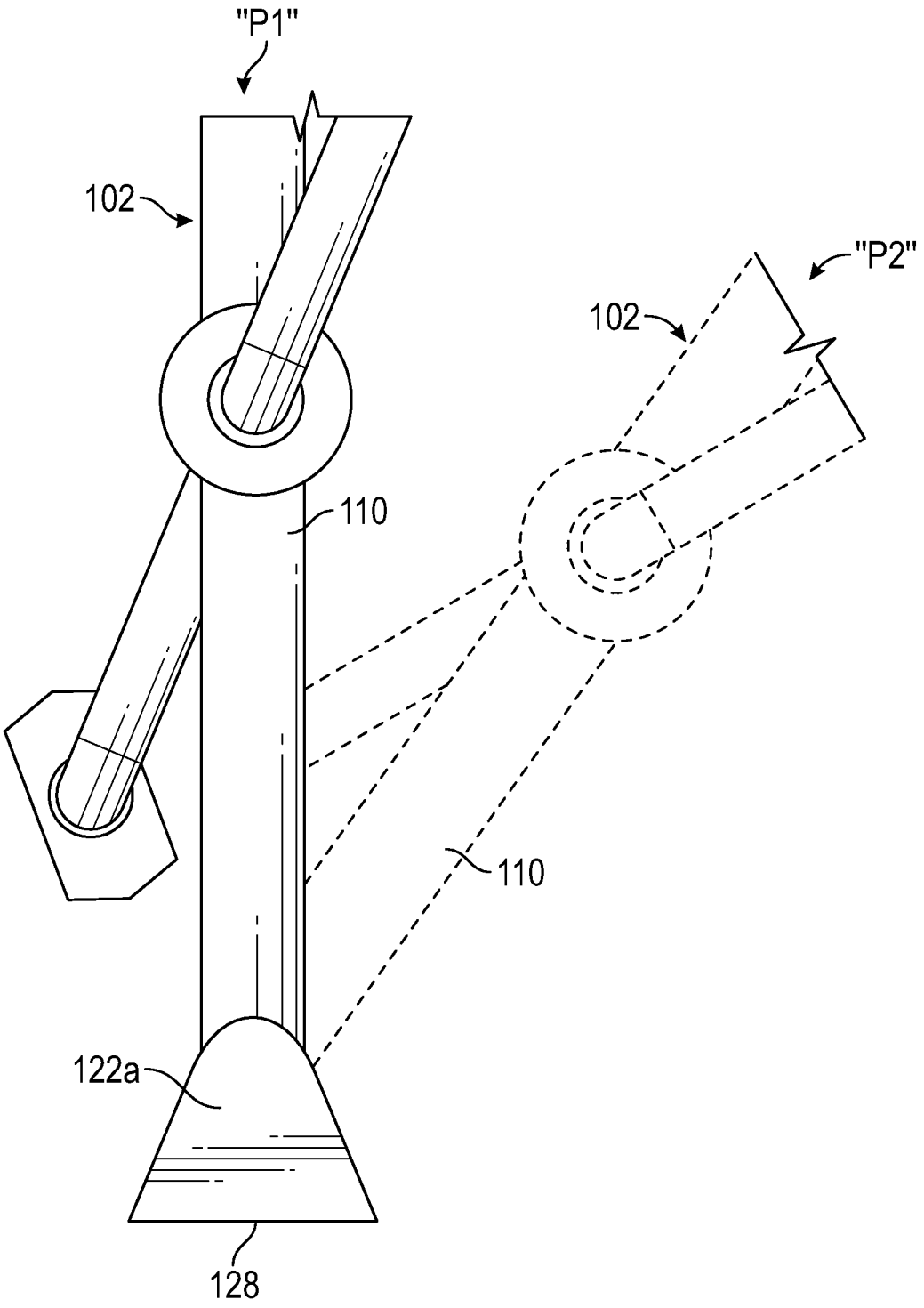
FIG. 2 is a partial side view illustrating the cycling device in a first or resting position and a second or in-use position.

With reference to FIGS. 1A-3, an exemplary embodiment of a cycling device such as an exercise device is illustrated and is generally designated 100. The cycling device 100 generally includes a handle assembly 102, a pedal assembly 104 coupled to the handle assembly 102, and a foot assembly 106 supporting the handle assembly 102 and pedal assembly 104 on a ground surface. The cycling device 100 is configured to be used by a seated person and is configured to pivot or rotate between a first or starting position "P1" (FIGS. 1A and 2) and a second or in-use position "P2" (FIGS. 1B and 2).

With reference to FIGS. 1A and 1B, the handle assembly 102 may be an elongate shaft having a handle portion 108 for grasping by a user, a base portion 110, and a handle extension 112 coupled between the handle portion 108 and the base portion 110. The handle portion 108 may be thicker than the remainder of the shaft assembly 102 and may have a grip fixed thereabout to assist a user in grasping the handle portion 108. The handle extension 112 may be a tubular member extending from the handle portion 108 and is received in the base portion 110. The extension 112 may be telescopically received in the base portion 110 to allow a user to adjust a height of the handle portion 108 relative to the base portion 110. The extension 112 may have a locking mechanism (not explicitly shown), such as, for example, a biased pin, configured for selective receipt in one of a plurality of openings defined along a length of the base portion 110. It is contemplated that the handle portion 108, the handle extension 112, and the base portion 108 are coaxial.

The pedal assembly 104 is coupled to the base portion 110 of the handle assembly 102 and includes a hub 113, a crankarm 114, a first pedal 116*a*, and a second pedal 116*b*. The hub 113 is fixed to the base portion 110 and the crankarm 114 extends through the hub 113 and perpendicularly through the base portion 110. The crankarm 114 is rotationally supported by the hub 113 and has an intermediate portion 114*a* disposed within the base portion 110, a first end portion 114*b*, such as, for example, a first L-shaped bar extending laterally outward of the base portion 110, and a second end portion 114*c*, such as, for example a second L-shaped bar extending laterally outward of the base portion 110 in an opposite direction as the first end portion 114*b*.

The first pedal 116*a* is rotationally supported on an end of the first end portion 114*b* of the crankarm 114 and the second pedal 116*b* is rotationally supported on an end of the second end portion 114*c* of the crankarm 114. As such, when a user applies a pedaling force on the first and second pedals 116*a*, 116*b*, the crankarm 114 is configured to rotate about a rotational axis "X" defined perpendicularly through the base portion 110.

The base portion 110 may include a tensioning mechanism (not explicitly shown) disposed within the hub 113 and configured to engage the intermediate portion 114*a* of the crankarm 114 to apply a selected resistance to rotation of the crankarm 114 relative to the hub 113. The tensioning mechanism may be a brake pad, a clamp, or the like and is operably coupled to the handle portion 108. The handle portion 108 may be configured to adjust the degree of engagement of the tensioning mechanism with the crankarm 114 in response to a rotation of the handle portion 108 relative to the base portion 110. For example, the tensioning mechanism may have a nut threadedly engaged to a threaded end of the handle portion 108 such that a rotation of the handle portion 108 moves the nut of the tensioning mechanism further or closer to the crankarm 114 to adjust the amount of tension or force applied to the crankarm 114. Once increasing the tension, more force will be needed to rotate the crankarm 114. In aspects, the tensioning mechanism may be constructed of any suitable material, such as, for example, rubber, plastic, or metal.

The foot assembly 106 generally includes a crossbar 120 defining a longitudinal axis "Y," a first foot 122*a*, and a second foot 122*b*. The crossbar 120 may be a monolithic structure monolithically formed with the base portion 110 of the handle assembly 102 or a detachable component or assemblies of parts coupled to the base portion 110. The crossbar 120 extends perpendicularly relative to the handle assembly 102 and has a first end portion, such as, for example, a first arm 124, and a second end portion, such as, for example, a second arm 126. The first arm 124 of the crossbar 120 extends laterally outward from an end of the base portion 110 and the second arm 126 of the crossbar 120 extends laterally outward from the end of the base portion 110 in an opposite direction as the first arm 124. The crossbar 120 may be a hollow tube defining a channel therethrough.

The first foot 122*a* is rotationally coupled to the first arm 124 of the crossbar 120 and the second foot 122*b* is rotationally coupled to the second arm 126 of the crossbar 120 such that the crossbar 120 is configured to rotate about the longitudinal axis "Y" thereof relative to the first and second feet 122*a*, 122*b* to adjust an angular position of the handle assembly 102, as will be described in further detail below. The first and second feet 122*a*, 122*b* are generally triangular having a flat bottom 128 configured to sit flush on a ground surface. Other suitable shapes for the feet 122*a*, 122*b* are also contemplated, such as, for example, square, circular, or the like. The feet 122*a*, 122*b* may be fabricated from any suitable material, such as, for example, rubber, plastic, or metal.

Figure 3:
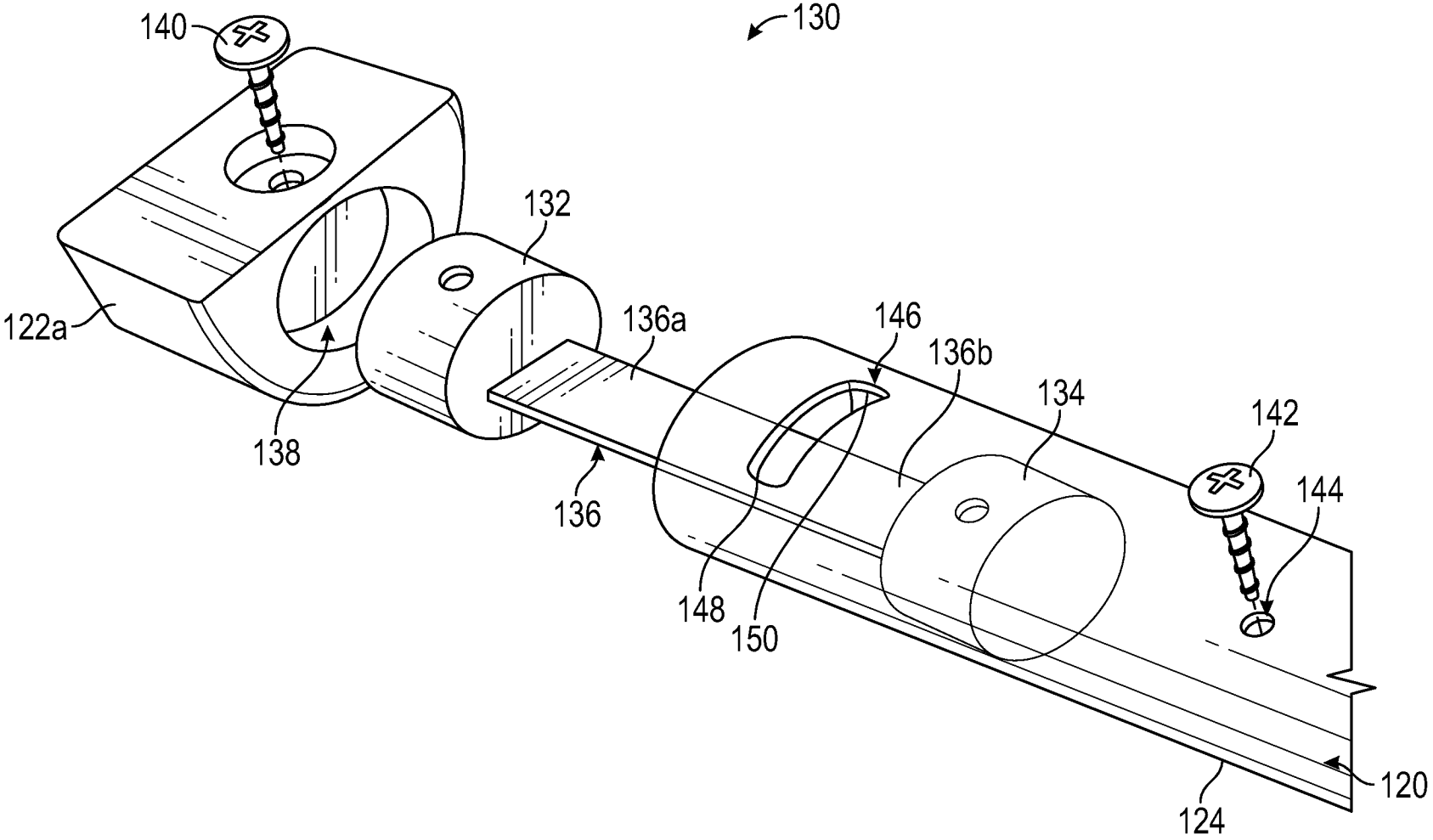
FIG. 3 is perspective view, with parts separated, illustrating a foot assembly of the cycling device of FIG. 1A.

With reference to FIG. 3, the foot assembly 106 includes a self-righting mechanism 130 coupled between the first arm 124 of the crossbar 120 and the first foot 122*a* for resiliently biasing the crossbar 120 along with the handle assembly 102 toward the first angular position "P1" (FIG. 2) relative to the first and second feet 122*a*, 122*b*. In aspects, another self-righting mechanism may also be provided between the second arm 126 and the second foot 122*b*. The self-righting mechanism 130 generally includes a first block 132, a second block 134, and a biasing member 136 coupled between the first and second blocks 132, 134. The biasing member 136 may be a torsion spring or bar or any other suitable spring.

The first block 132 is fixed to a first end 136*a* of the biasing member 136 and is received in a correspondingly-shaped opening 138 defined in the first foot 122*a*. The first block 132 may be cylindrically-shaped, but other suitable shapes for the first block 132 are also contemplated, such as, for example, disc-shaped, squared, triangular, or the like. The first block 132 is rotationally fixed relative to the first foot 122*a* via a fastener, such as, for example, a first set screw 140.

The second block 134 is fixed to a second end 136*b* of the biasing member 136 and rotationally fixed to the first arm 124 of the crossbar 120 via another fastener, such as, for example, a second set screw 142. The second set screw 142 is received in an opening 144 defined through the first arm 124 and is secured to the second block 134. As such, as the crossbar 120 rotates about the longitudinal axis "Y" (FIG. 1A) thereof, the second block 134 rotates therewith and relative to the first block 132 and the first foot 122*a* against the resilient bias of the biasing member 136. The second block 134 may be cylindrically-shaped, but other suitable shapes are also contemplated.

With continued reference to FIG. 3, the first arm 124 of the crossbar 120 has an end received in the opening 138 of the first foot 122*a* and disposed about the first block 132. The end of the first arm 124 defines a slot 146 therein that extends partially around the circumference of the end of the first arm 124. The first set screw 140 extends through the first foot 122*a*, the slot 146 in the crossbar 120, and is secured to the first block 132. The slot 146 has opposite ends defining edges 148, 150 for engagement with the first set screw 140 as the crossbar 120 rotates relative to the first foot 122*a*. As such, the edges 148, 150 function as limits or stops to limit rotation of the crossbar 120 relative to the feet 122*a*, 122*b* between the first and second positions "P1", "P2" (FIG. 2).

In use, a user may sit on a chair or other suitable support surface and grasp the handle portion 108 of the cycling device 100. In the starting or first position "P1" of the handle assembly 102, as shown in FIGS. 1A and 2, the handle assembly 102 of the cycling device 100 is perpendicular to a ground surface and maintained in the first position via the self-righting mechanism 130 (FIG. 3). To move the handle assembly 102 to an in-use position "P2," as shown in FIGS. 1B and 2, the user pulls or rotates the handle portion 108 toward themselves against the resilient bias of the biasing member 136 of the self-righting mechanism 130. The crossbar 120 rotates about the longitudinal axis "Y" thereof and relative to the first and second feet 122*a*, 122*b* while the first and second feet 122*a*, 122*b* are maintained in flush engagement with the ground surface. The first and second feet 122*a*, 122*b* are the only points of contact between the cycling device 100 and the ground surface.

The handle portion 108 may be rotated toward the user until the edge 150 of the slot 146 in the crossbar 120 engages the first set screw 140 of the self-righting mechanism 130, whereby the first set screw 140 prevents or stops further rotation of the handle assembly 102 relative to the feet 122*a*, 122*b*. With the handle assembly 102 in the second or in-use angular orientation "P2," the user may position their feet on the foot pedals 116*a*, 116*b* of the pedal assembly 104 and begin to pedal. To adjust an amount of resistance experienced by the user to pedaling, the user may rotate the handle portion 102 about its longitudinal axis to cause the tensioning mechanism to engage the crankarm 114 with an increased or decreased force.

When a user is finished using the cycling device 100, they may release the handle portion 108, whereby the spring force of the biasing member 136 of the self-righting mechanism 130 is now allowed to act on the crossbar 120. More specifically, the biasing member 136, which is in a loaded state, drives a rotation of the crossbar 120 and the attached handle assembly 102 relative to the stationary feet 122*a*, 122*b* from the second position "P2" toward the first position "P1." Upon the handle assembly 102 moving to the first position "P1," the edge 148 of the slot 146 engages the first set screw 140 whereby the first set screw 140 stops further rotation of the handle assembly 102. The handle assembly 102 is maintained in the first position "P1" by due to the interaction between the biasing member 136, the first set screw 140, and the edge 148 of the slot 146 of the crossbar 120.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended thereto.

What is claimed is:

1. A cycling device for exercise or rehabilitation, the cycling device comprising:
- an elongate shaft having a handle portion and a base portion;
- a pedal assembly coupled to the elongated shaft; and
- a foot assembly including:
  - a crossbar defining a longitudinal axis, the crossbar being coupled to the base portion and having a first end portion and a second end portion;
  - a first foot coupled to the first end portion of the crossbar; and
  - a second foot coupled to the second end portion of the crossbar, wherein the crossbar is configured to rotate about the longitudinal axis thereof relative to the first and second feet to adjust an angular position of the handle portion of the elongate shaft, wherein the crossbar is resiliently biased toward a set rotational orientation relative to the first and second feet.

2. The cycling device according to claim 1, wherein the foot assembly further includes a biasing member coupled between the first foot and the crossbar to resiliently bias the crossbar toward the set rotational orientation.

3. The cycling device according to claim 2, wherein the foot assembly further includes:
- a first block rotationally fixed in the first foot and fixed to the biasing member; and
- a second block rotationally fixed to the crossbar and fixed to the biasing member such that the second block is configured to rotate relative to the first block in response a rotation of the crossbar relative to the first and second feet.

4. The cycling device according to claim 3, wherein the foot assembly further includes a fastener fixed relative to the first foot, the crossbar defining a slot configured for receipt of the fastener such that the fastener limits an amount of rotation of the crossbar relative to the first and second feet in opposing first and second rotational directions.

5. The cycling device according to claim 4, wherein the fastener fixes the first foot to the first block.

6. The cycling device according to claim 4, wherein the first end portion of the crossbar defines the slot, the first end portion of the crossbar being rotationally supported in the first foot and disposed about the first block.

7. The cycling device according to claim 3, wherein the biasing member is a torsion spring.

8. The cycling device according to claim 1, wherein the first foot has a flat bottom configured to be flush with a ground surface.

9. The cycling device according to claim 8, wherein the elongate shaft is perpendicular relative to the flat bottom of the first foot when the crossbar is in the set rotational orientation relative to the first and second feet.

10. The cycling device according to claim 1, wherein the pedal assembly includes:

a crankarm rotationally supported by the base portion of the elongate shaft and having a first end portion and a second end portion;

a first pedal coupled to the first end portion of the crankarm; and a second pedal coupled to the second end portion of the crankarm.

11. The cycling device according to claim 10, wherein the handle portion is rotatable relative to the base portion to adjust a tensioning mechanism associated with the crankarm.

12. The cycling device according to claim 10, wherein the elongate shaft includes a handle extension coupled between the handle portion and the base portion.

13. The cycling device according to claim 1, wherein when the cycling device is in use, no portion of the cycling device is configured to contact a ground surface other than the first and second feet.

14. The cycling device according to claim 1, wherein the crossbar extends perpendicularly relative to the base portion.

15. A cycling device for exercise or rehabilitation, the cycling device comprising:

an elongate shaft having a handle portion and a base portion;

a pedal assembly coupled to the elongate shaft; and a foot assembly including:

a first arm coupled to the base portion and supporting a first foot;

a second arm coupled to the base portion and supporting a second foot, the first and second arms being configured to rotate relative to the first and second feet between a first position, in which the handle portion is disposed at a first angular orientation relative to the first and second feet, and at least one second position, in which the handle portion is disposed at a second angular orientation relative to the first and second feet, wherein at least the first arm is resiliently biased toward the first position.

16. The cycling device according to claim 15, wherein the foot assembly further includes a biasing member coupled between the first foot and the first arm to resiliently bias the first arm toward the first position.

17. The cycling device according to claim 16, wherein the foot assembly further includes:

a first block rotationally fixed in the first foot and fixed to the biasing member; and a second block rotationally fixed in the first arm and fixed to the biasing member such that the second block is configured to rotate relative to the first block in response to a rotation of the first arm relative to the first foot.

18. The cycling device according to claim 17, wherein the foot assembly further includes a fastener fixed relative to the first foot, the first arm defining a slot configured for receipt of the fastener such that the fastener limits an amount of rotation of the first arm relative to the first foot in opposing first and second rotational directions.

19. The cycling device according to claim 18, wherein the fastener fixes the first foot to the first block.

* * * * *